US012030532B2

(12) United States Patent
Czerwinka et al.

(10) Patent No.: US 12,030,532 B2
(45) Date of Patent: Jul. 9, 2024

(54) RUNNING GEAR FOR A RAIL VEHICLE

(71) Applicant: Siemens Mobility Austria GmbH, Vienna (AT)

(72) Inventors: Thomas Czerwinka, Weitendorf (AT); David Kreuzweger, Lieboch (AT); Christian Moser, Graz (AT); Alexander Prix, Graz (AT); Jochen Ringswirth, Graz (AT); Gerald Schobegger, Graz (AT); Peter Seitz, Pommelsbrunn (DE); Martin Teichmann, Graz (AT)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 952 days.

(21) Appl. No.: 17/042,073

(22) PCT Filed: Mar. 27, 2018

(86) PCT No.: PCT/EP2018/057720
§ 371 (c)(1),
(2) Date: Sep. 25, 2020

(87) PCT Pub. No.: WO2019/185119
PCT Pub. Date: Oct. 3, 2019

(65) Prior Publication Data

US 2021/0094591 A1 Apr. 1, 2021

(51) Int. Cl.
*B61F 5/30* (2006.01)
*B61F 3/04* (2006.01)

(52) U.S. Cl.
CPC ..... *B61F 5/308* (2013.01); *B61F 3/04* (2013.01)

(58) Field of Classification Search
CPC ..... B61F 3/02; B61F 3/04; B61F 5/26; B61F 5/301; B61F 5/305; B61F 5/307; B61F 5/308
See application file for complete search history.

(56) References Cited

U.S. PATENT DOCUMENTS 6,247,413 B1 6/2001 Teichmann
7,540,242 B2 6/2009 Sommerer
(Continued)

FOREIGN PATENT DOCUMENTS

CN 1240397 1/2000
CN 101098808 1/2008
(Continued)

OTHER PUBLICATIONS

PCT International Search Report dated Nov. 4, 2018 based on PCT/EP2018/057720 filed Mar. 27, 2018.

*Primary Examiner* — Robert J McCarry, Jr.
(74) *Attorney, Agent, or Firm* — Cozen O'Connor

(57) ABSTRACT

Running gear for a rail vehicle includes a first drive unit, a running gear frame and a wheelset, wherein the first drive unit is supported via a first spring device and a second spring device on a first wheelset bearing housing or on a first swing arm and via a third spring device and a fourth spring device on a second wheelset bearing housing or on a second swing arm, where a first damper device, arranged between the first wheelset bearing housing or the first swing arm and the drive unit, is advantageously connected in parallel with the first spring device, the second spring device, the third spring device and the fourth spring device, where the damping device has a damper and, connected in series therewith, a first stop buffer and a second stop buffer to achieve a space-saving drive bearing having effective suspension and damping.

16 Claims, 2 Drawing Sheets

(56) References Cited

U.S. PATENT DOCUMENTS

| | | | |
|---|---|---|---|
| 7,908,974 | B2 | 3/2011 | Hewitt et al. |
| 9,694,831 | B2 | 7/2017 | Kreuzweger et al. |
| 2008/0196618 | A1 | 8/2008 | Sommerer |
| 2009/0031918 | A1 | 2/2009 | Hewitt et al. |
| 2015/0144026 | A1 | 5/2015 | Kreuzweger et al. |
| 2016/0001793 | A1 | 1/2016 | Haigermoser et al. |

FOREIGN PATENT DOCUMENTS

| | | | | |
|---|---|---|---|---|
| CN | 101247979 | | 8/2008 | |
| CN | 202016475 | U | 10/2011 | |
| CN | 105443654 | | 3/2016 | |
| CN | 104245472 | | 12/2017 | |
| CN | 207128903 | U | 3/2018 | |
| DE | 2657447 | | 6/1978 | |
| EP | 0589866 | | 3/1994 | |
| EP | 0930210 | | 7/1999 | |
| EP | 2964506 | | 1/2016 | |
| EP | 2964506 | A1 * | 1/2016 | ..... B61C 17/00 |
| WO | 2017133954 | | 8/2017 | |

* cited by examiner

RUNNING GEAR FOR A RAIL VEHICLE

CROSS-REFERENCE TO RELATED APPLICATIONS

This is a U.S. national stage of application No. PCT/EP2018/057720 filed 27 Mar. 2018.

BACKGROUND OF THE INVENTION

1. Field of the Invention

The invention relates to a running gear for a rail vehicle, in particular an internally supported running gear, comprising at least one first drive unit and at least one running gear frame, to which at least one wheelset is coupled via a first wheelset bearing and a second wheelset bearing, where the at least first drive unit is supported by a first spring device and a second spring device on a first wheelset bearing housing or a first swing arm and by a third spring device and a fourth spring device on a second wheelset bearing housing or a second swing arm.

2. Description of the Related Art

Mechanically decoupled bearings for drive units on running gears of rail vehicles are in particular important in high-speed trains because the intensity of dynamic reactions, which are, for example, transmitted from a track to components of the running gear due to track position errors, increase as the travel speed increases. Bearings for drive units must be formed or dimensioned in accordance with the expected dynamic reactions and arranged on the running gear. Herein, a carefully configured suspension and damping capacity is particularly important.

Furthermore, particularly in the case of internally supported running gears and particularly in the case of drives that are coaxial to wheelset shafts, it is frequently necessary to take account of a greatly restricted installation space when arranging and dimensioning bearings for drive units.

WO 2017/133954 A1, for example, describes an internally supported running gear comprising a running gear frame, a transversely mounted drive motor and a transmission. At least three elastic bearings are arranged between the drive motor and the running gear frame, where each one of these elastic bearings is provided on at least one of two longitudinal bearings of the running gear frame. Attachment modules allowing quick replacement of the drive motors can be provided between the drive motor and the running gear frame.

EP 2 964 506 B1 describes a running gear for a rail vehicle comprising a running gear frame, a drive unit and in particular internally supported wheelsets. The drive unit includes an electric motor, a transmission and a coupling and is mounted at least partially elastically or movably on the running gear frame. Spring devices are provided between the drive unit and wheelset bearing housings. Furthermore, a telescopic damper aligned transversely or predominantly transversely to the direction of travel is arranged between the drive unit and wheelset bearing housing.

In their conventional forms, the foregoing approaches have the disadvantage of drive bearings or drive suspension and damping that heavily utilize the available installation space, with, in particular transverse to the direction of travel, short spring travel distances and a strong transmission of vibrations.

SUMMARY OF THE INVENTION

In view of the foregoing, it is therefore an object of the invention to provide a running gear that has been further developed in comparison to the prior art with a compact drive bearing that is nevertheless effective in reducing vibrations.

This and other object and advantages are achieved in accordance with the invention by a running gear in which, at least between the first wheelset bearing housing or the first swing arm, on the one hand, and the at least first drive unit, on the other, a first damper device, which comprises a damper and, connected effectively in series thereto, a first stop buffer and a second stop buffer, is arranged in an effective parallel connection to the first spring device, the second spring device, the third spring device and the fourth spring device.

The first stop buffer and the second stop buffer on the first damper device enable this to be installed with a certain distance from components surrounding the running gear (for example, from the first wheelset bearing housing). This, on the one hand, enables free expansion and compression processes of the first spring device, the second spring device, the third spring device and the fourth spring device and, on the other, enables an intervention of the first stop buffer or the second stop buffer limiting these free expansion and compression processes achieves a defined damping of movements of the first drive unit. Enabling free expansion and compression processes reduces vibrations transmitted between the first drive unit and the first wheelset bearing housing and the second wheelset bearing housing. The limiting intervention of the first stop buffer or the second stop buffer avoids an excessive increase in spring forces.

It is favorable for the first spring device, the second spring device, the third spring device and the fourth spring device to be prestressed in the direction of a longitudinal axis of a running gear. This measure generates corresponding bearing reactions and compensates weight forces and driving and braking forces.

In an advantageous embodiment, at least the first spring device and the second spring device are arranged opposite one another. This measure achieves a suspension and supporting effect in two opposing directions thus enabling compensation of driving and braking forces with different directions of action.

It is furthermore favorable for the at least first damper device to be arranged between the first spring device and the second spring device. This achieves a particularly space-saving drive bearing, thus, for example, enabling the alignment of the top of the first wheelset bearing housing of the first spring device, the second spring device and the damper device.

It can be advantageous for the first spring device, the second spring device, the third spring device and the fourth spring device to be embodied as laminated springs. Laminated springs have defined stiffnesses in three spatial directions thus enabling a high load-bearing capacity of the first spring device, the second spring device, the third spring device and the fourth spring device in three spatial directions and enabling flexible installation positions. Furthermore, the laminated springs achieve a certain intrinsic damping of the first spring device, the second spring device, the third spring device and the fourth spring device.

In another favorable embodiment, the first spring device, the second spring device, the third spring device and the fourth spring device are formed as wire rope dampers. This measure, on the one hand, achieves effective absorption of impacts between the first drive unit, on the one hand, and the first wheelset bearing housing and the second wheelset bearing housing, on the other.

in an advantageous embodiment, the damper of the at least first damper device is formed as a hydraulic bearing. From the intervention of the first stop buffer, this measure achieves drive bearings with effective vibration damping in all three spatial directions, on the one hand, and defined bracing, on the other.

It is favorable for a first holder to which the first spring device is connected and a second holder to which the second spring device is connected to be formed at least from the first wheelset bearing housing. This measure enables separate adapters, such as screwed to the first wheelset bearing housing, or welded brackets for attaching the first spring device and the second spring device to be dispensed with.

In an advantageous embodiment, the at least first damper device is encased by the first wheelset bearing housing or the swing arm, the first holder, the second holder and a cover connected to the first holder and the second holder. This measure provides a certain protection for the first damper device (for example, against stone impact) and in addition the first wheelset bearing housing or the swing arm, on the one hand, and the cover, on the other, function as contact bodies for the first stop buffer and the second stop buffer.

It is further favorable for the at least one first carrier to which the first spring device, the second spring device and the at least first damper device are connected to be coupled to the at least first drive unit. Here, the first carrier functions as an adapter module and is hence exchangeable. This measure enables the first spring device, the second spring device and the first damper device to be exchanged in a state connected to the first carrier and therefore quickly.

Furthermore, this enables the first spring device, the second spring device and the first damper device to remain in use on a replacement of the first drive unit, for example by a drive unit with smaller dimensions than those of the first drive unit. In such a case, only the first carrier has to be exchanged, if necessary.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The following explains the invention in more detail with reference to exemplary embodiments, in which.

DETAILED DESCRIPTION OF THE EXEMPLARY EMBODIMENTS

Figure 1:
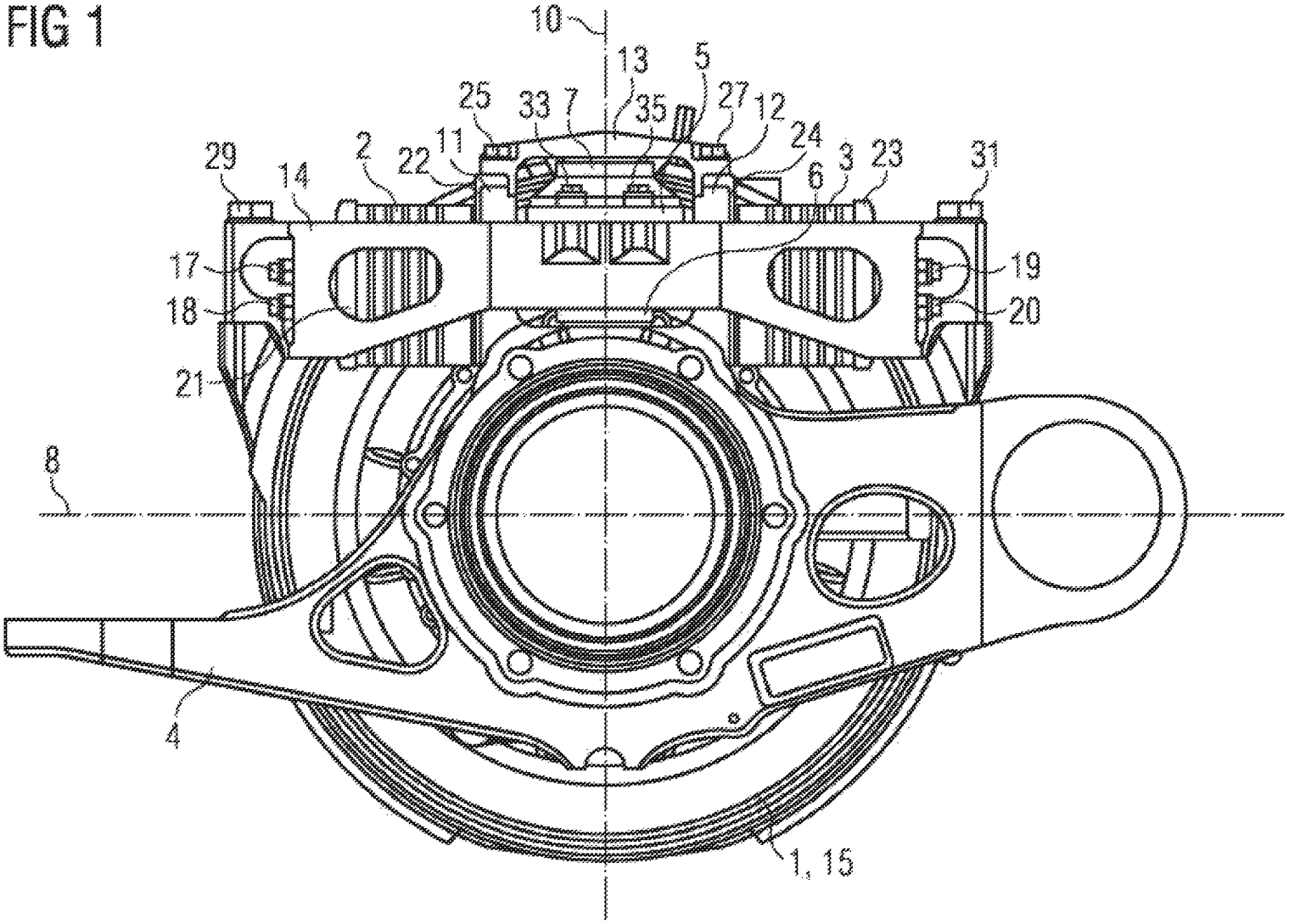
FIG. 1 shows a side view of a section of an exemplary embodiment of a running gear in accordance with the invention with a first drive unit, which is supported in a sprung and damped manner on a first wheelset bearing housing and a second wheelset bearing housing

A section of an internally supported running gear of a rail vehicle depicted in a side view in FIG. 1 comprises a running gear frame (not depicted) to which a first wheelset and a second wheelset (also not shown) are coupled.

A first wheelset bearing (not depicted) with a first wheelset bearing housing 4 or a first swing arm and a first wheelset guide bush (also not shown), and a second wheelset bearing with a second wheelset bearing housing or a second swing arm and a second wheelset guide bush (also not depicted), are provided between the first wheelset and the running gear frame.

A third wheelset bearing with a third wheelset bearing housing and a third wheelset guide bush and a fourth wheelset bearing with a fourth wheelset bearing housing and a fourth wheelset guide bush, also not shown, are arranged between the second wheelset and the running gear frame.

Furthermore, a first primary spring (not depicted) is provided between the running gear frame and the first wheelset bearing housing 4, a second primary spring (not depicted) is provided between the running gear frame and the second wheelset bearing housing, a third primary spring, not shown, is provided between the running gear frame and the third wheelset bearing housing and a fourth primary spring, not shown, is provided between the running gear frame and the fourth wheelset bearing housing.

A first drive unit 1 is arranged coaxially to the first wheelset, a second drive unit, not depicted, is arranged coaxially to the second wheelset.

Torque arms (not shown) for transmitting driving and braking torques or introducing them from the first drive unit 1 and the second drive unit into the running gear frame are arranged between the first drive unit 1 and the running gear frame and between the second drive unit and the running gear frame.

The first drive unit 1 is connected via a first spring device 2, a second spring device 3 and a first damper device 5, which form a first bearing device, to the first wheelset bearing housing 4 and via a third spring device, a fourth spring device and a second damper device, which form a second bearing device (not depicted) to the second wheelset bearing housing.

The second drive unit is connected via a fifth spring device, a sixth spring device and a third damper device, which form a third bearing device (not shown) to the third wheelset bearing housing and via a seventh spring device, an eighth spring device and a fourth damper device, which form a fourth bearing device (not depicted) to the fourth wheelset bearing housing.

In accordance with the disclosed embodiments of the invention, it is also conceivable, for example, only to provide the first damper device 5 between the first drive unit 1 and the first wheelset bearing housing 4 or the second wheelset bearing and only to provide the third damper device between the second drive unit and the third wheelset bearing housing or the fourth wheelset bearing housing, i.e., to dispense with the second damper device and the fourth damper device.

The first bearing device, the second bearing device, the third bearing device and the fourth bearing device are similar with respect to structural and functional properties. Therefore, only the first bearing device is described in detail, here.

The first bearing device is arranged upstream of the first drive unit 1 in the region of a first drive end face 15. The first spring device 2 and the second spring device 3 are formed as laminated springs and arranged horizontally, i.e., their longitudinal axes extend in a non-deflected state of the first spring device 2 and the second spring device 3, shown in FIG. 1, parallel to a longitudinal axis of a running gear 8.

This achieves favorable utilization of an available installation space in the direction of a vertical axis of the running gear 10 and hence a compact construction.

The first wheelset bearing housing 4 has a first holder 11 and a second holder 12, which are formed via a casting process from the first wheelset bearing housing 4 and extend in the direction of the vertical axis of the running gear 10.

The first spring device 2 is connected via a first baseplate 21 to a first carrier 14 and via a second baseplate 22 formed as a mounting bracket to the first holder 11.

The first baseplate 21 has a first threaded bolt 17 and a second threaded bolt 18, via which the first spring device 2 is screwed via corresponding nuts to the first carrier 14.

The second spring device 3 is connected via a third baseplate 23 to the first carrier 14 and via a fourth baseplate 24 formed as a mounting bracket to the second holder 12.

The third baseplate 23 has a third threaded bolt 19 and a fourth threaded bolt 20 via which the second spring device 3 is screwed via corresponding nuts to the first carrier 14.

A cover 13 is arranged above the first holder 11 and the second holder 12. This cover is connected via a first screw 25, a second screw 26, shown in FIG. 2, a third screw 27 and a fourth screw 28, visible in FIG. 2, which are formed as hexagon head screws with blind holes, to upper sides of the first holder 11 and the second holder 12 and to top sides of the second baseplate 22 and the fourth baseplate 24, where these top sides are aligned in the direction of the longitudinal axis of a running gear 8. The second baseplate 22 is clamped between the cover 13 and the first holder 11 in the region of its top side, the fourth baseplate 24 is clamped between the cover 13 and the second holder 12 in the region of its top side.

Longitudinal axes of the first screw 25, the second screw 26, the third screw 27 and the fourth screw 28 are aligned in the direction of the vertical axis of the running gear 10. The first carrier 14 is screwed via a fifth screw 29, a sixth screw 30, visible in FIG. 2, a seventh screw 31, an eighth screw 32, shown in FIG. 2, and further screws, not shown, to the first drive unit 1. Longitudinal axes of the fifth screw 29, the sixth screw 30, the seventh screw 31, the eighth screw 32 and the further screws extend in the direction of the vertical axis of the running gear 10.

In the region of the first spring device 2 and the second spring device 3, the first carrier 14 is frame-shaped. The first spring device 2 and the second spring device 3 are arranged opposite one another in this frame-shaped region between the first carrier 14 and the first holder 11 or the second holder 12 under prestress, where corresponding prestressing forces of the first spring device 2 and the second spring device 3 act in opposite directions.

Figure 2:
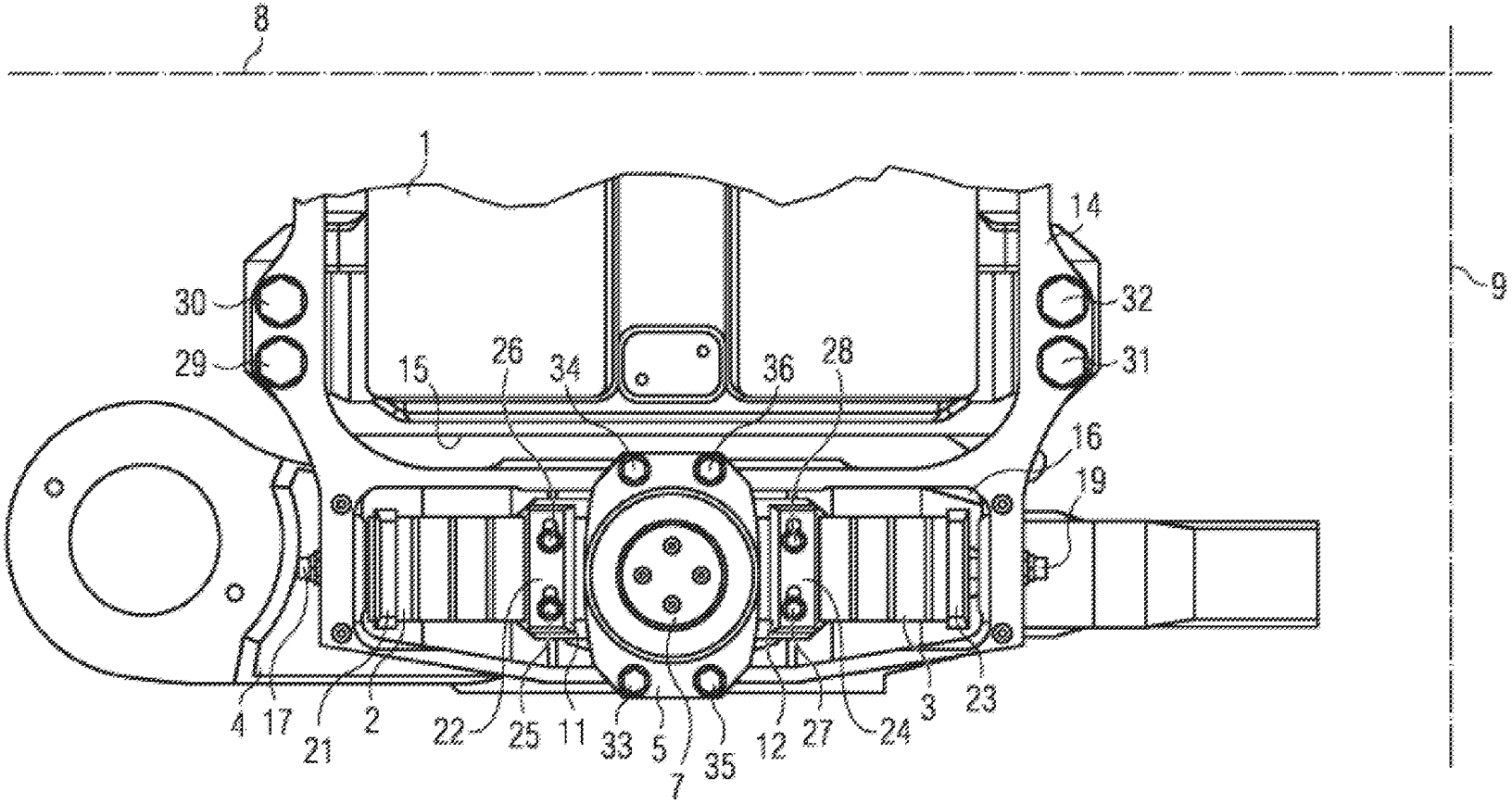
FIG. 2: shows a top view of a section of the exemplary emodiment of a running gear in accordance with the invention shown in FIG. 1.

The first spring device 2 and the second spring device 3 can be loaded in three spatial directions (for example, by driving, braking and weight forces of the first drive unit 1) and have corresponding stiffnesses in the direction of the longitudinal axis of a running gear 8, in the direction of transverse axis of the running gear 9, visible in FIG. 2, and in the direction of the vertical axis of the running gear 10, where the stiffness is greatest in the direction of the vertical axis of the running gear 10 and lowest in the direction of the transverse axis of the running gear 9, where maximum deflections of 15 mm are provided in the direction of the transverse axis of the running gear 9, thus achieving reduced wear and hence increased service life.

As an alternative to an embodiment of the first spring device 2 and the second spring device 3 as laminated springs, these can also be formed as wire rope dampers or fluid springs (for example, as air springs as or oil-pressure springs.

When they are formed as wire rope dampers, corresponding attachment modules are connected to the first carrier 14 and the first holder 11 or the second holder 12. Wire ropes that generate a suspension and damping effect between the first drive unit 1 and the first wheelset bearing housing 4 are clamped between the attachment modules or between the first carrier 14 and the first holder 11, on the one hand, and the first carrier 14 and the second holder 12, on the other.

When the first spring device 2 and the second spring device 3 are formed as air springs, the first spring device 2 and the second spring device 3 are connected pneumatically to a compressed air system of the rail vehicle, such as for a brake and a secondary spring, i.e., via compressed air pipes. When the first spring device 2 and the second spring device 3 are formed as air springs, corresponding air bellows are arranged between the first carrier 14 and the first holder 11 or the second holder 12, the stiffnesses of which can be set via an electronic air-spring control facility.

Furthermore, the first damper device 5 is screwed to an upper side of the first carrier 14, where a nineth screw 33, a tenth screw 34, visible in FIG. 2, an eleventh screw 35 and a twelfth screw 36, shown in FIG. 2, which are embodied as hexagon head blind-hole bolts, are provided between the first carrier 14 and the first damper device 5.

The first damper device 5 is arranged between the first spring device 2 and the second spring device 3, connected effectively parallel thereto and encased by the first wheelset bearing housing 4, the first holder 11, the second holder 12 and the cover 13. This, on the one hand, achieves a particularly space-saving arrangement and, on the other, also protects the first damper device 5 (for example against stone impact).

The first damper device 5 has a damper formed as a hydraulic bearing and a first stop buffer 6 on its underside and a second stop buffer 7 on its upper side. The damper includes two chambers filled with hydraulic fluid and has stiffnesses and damping effects in the direction of the longitudinal axis of a running gear 8, the transverse axis of the running gear 9 and the vertical axis of the running gear 10. The hydraulic bearing achieves effective damping at both low and high excitation frequencies.

In accordance with the disclosed embodiments of the invention, instead of the hydraulic bearing, it is also possible to use a rubber damper as a damper in the first damper device 5.

The damper is effectively connected in series or in a row to the first stop buffer 6 and the second stop buffer 7. In the non-deflected state of the first spring device 2 and the second spring device 3 depicted in FIG. 1, a distance of 5 mm is provided in each case between the first stop buffer 6 and the first wheelset bearing housing 4 and between the second stop buffer 7 and the cover 13, i.e., between the first stop buffer 6 or the second stop buffer 7 and components of the running gear surrounding them.

If the first spring device 2 and the second spring device 3 are deflected downward, such as in the direction of the vertical axis of the running gear 10, after a distance of 5 mm based on the non-deflected state shown of the first spring device 2 and the second spring device 3 (i.e., in a defined state of deflection of the first spring device 2 and the second spring device 3), then the first stop buffer 6 strikes the first wheelset bearing housing 4 and is supported thereupon or can slide toward it (i.e., the first stop buffer 6 also functions as a sliding plate). Only on the intervention of the first stop buffer 6 or when it comes into contact with the first wheelset bearing housing 4 does the damping effect of the damper take effect.

If the first spring device 2 and the second spring device 3 are deflected upward, such as in the direction of the vertical axis of the running gear 10, after a distance of 5 mm based on the non-deflected state shown of the first spring device 2 and the second spring device 3, then the second stop buffer 7 strikes the cover 13 and is supported thereupon or can slide toward it (the second stop buffer 7 can also function as a sliding plate). On the intervention of the second stop buffer 7 or when it comes into contact with the cover 13, the damping effect of the damper takes effect.

The gradual intervention of the first damper device 5 and the second damper device enables effective damping of movements or vibrations between the first drive unit 1 and the first wheelset bearing housing 4 to be achieved with relatively short spring excursion distances even on routes where the track is in poor condition.

In accordance with disclosed embodiments of the invention, it is also conceivable for the first stop buffer 6 and/or the second stop buffer 7 of the first damper device 5 to be spatially, but not functionally, separate from the damper. For example, the first stop buffer 6 can be arranged on the first wheelset bearing housing 4 and/or the second stop buffer 7 on an underside of the cover 13.

FIG. 2 shows the embodiment of a running gear in accordance with the invention depicted in FIG. 1 as a top view. Therefore, the same reference numbers as those in in FIG. 1 are used in some cases. As in FIG. 1, FIG. 2 does not depict any wheelsets, any running gear frames, any primary springs of the running gear, etc.

The running gear has a first drive unit 1, which is connected via a first bearing device to a first wheelset bearing housing 4 and via a second bearing device(not shown) that is formed structurally and functionally the same as the first bearing device to a second wheelset bearing housing (also not depicted).

The first bearing device has a first spring device 2, a second spring device 3, which are formed as laminated springs, and a first damper device 5 with a first stop buffer 6, shown in FIG. 1, and a second stop buffer 7 and is arranged upstream of the first drive unit 1 in the region of a first drive end face 15.

The first spring device 2 and the second spring device 3 are provided within a frame-shaped first recess 16 of a first carrier 14, where the first spring device 2 is screwed via a first threaded bolt 17 and a second threaded bolt 18 with corresponding nuts and the second spring device 3 via a third threaded bolt 19 and a fourth threaded bolt 20 and corresponding nuts to the first carrier 14.

The first spring device 2 is furthermore connected via a first screw 25 and a second screw 26 to a first holder 11 of the first wheelset bearing housing 4, and the second spring device 3 is connected via a third screw 27 and a fourth screw 28 to a second holder 12 of the first wheelset bearing housing 4.

The first carrier 14 is formed symmetrically with respect to a longitudinal axis of a running gear 8, frames the first drive unit 1 and is connected via a fifth screw 29, a sixth screw 30, a seventh screw 31, an eighth screw 32 and further screws (not shown) to the first drive unit 1.

The fifth screw 29 and the seventh screw 31 are formed as hexagon head blind-hole screws, and the sixth screw 30 and the eighth screw 32 are formed as hexagon head through-screws.

The second bearing device is arranged in the region of a second drive end face, not depicted, opposite the first drive end face 15 or upstream thereof. A third spring device and a fourth spring device, not shown, are provided in a frame-shaped second recess (not visible) of the first carrier 14.

The first damper device 5 is screwed via a nineth screw 33, a tenth screw 34, an eleventh screw 35 and a twelfth screw 36 to the first carrier 14 on an upper side of the first carrier 14 in the region of the first recess 16 between the first spring device 2 and the second spring device 3. A cover 13, visible in FIG. 1, is arranged above the first damper device 5 and connected via the first screw 25 and the second screw 26 to the first holder 11 and via the third screw 27 and the fourth screw 28 to the second holder 12.

The first spring device 2 and the second spring device 3 can be deflected in the direction of the longitudinal axis of a running gear 8, a transverse axis of the running gear 9 and in the direction of a vertical axis of the running gear 10, visible in FIG. 1, and also bent or rotated about the longitudinal axes thereof.

The first damper device 5 effects damping as soon as the first stop buffer 6 comes into contact with the first wheelset bearing housing 4 or the second stop buffer 7 comes into contact with the cover 13. The mode of operation of the first damper device 5 is described in detail in conjunction with FIG. 1.

In accordance with the disclosed embodiments of the invention, it is also possible to dispense with the first carrier 14 and the first bearing device can be connected directly to a housing of the first drive unit 1.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A running gear for a rail vehicle, comprising:

at least one first drive unit;

at least one running gear frame to which at least one wheelset is coupled via a first wheelset bearing and a second wheelset bearing, the at least first drive unit being supported by a first spring device and a second spring device on a first wheelset bearing housing or a first swing arm and by a third spring device and a fourth spring device on a second wheelset bearing housing or a second swing arm; and a first damper device comprising a damper and, connected effectively in series thereto, a first stop buffer and, a second stop buffer, arranged in an effective parallel connection to the first spring device, the second spring device, the third spring device and the fourth spring device at least between the first wheelset bearing housing or the first swing arm, on the one hand, and the at least first drive unit, on the other;

wherein stiffnesses of the first spring device and the second spring device are greater in the direction of a longitudinal axis of a running gear than the stiffnesses in a direction of a transverse axis of the running gear and in a direction of a vertical axis of the running gear.

2. The running gear as claimed in claim 1, wherein up to a defined state of deflection of the first spring device, the second spring device, the third spring device and the fourth spring device, a first stop surface of the at least first stop buffer is distanced from components of the running gear surrounding the at least first stop buffer.

3. The running gear as claimed in claim 2, wherein the first spring device, the second spring device, the third spring device and the fourth spring device are prestressed in a direction of a longitudinal axis of a running gear.

4. The running gear as claimed in claim 1, wherein the first spring device, the second spring device, the third spring device and the fourth spring device are prestressed in a direction of a longitudinal axis of a running gear.

5. The running gear as claimed in claim 1, wherein at least the first spring device and the second spring device are arranged opposite one another.

6. The running gear as claimed in claim 1, wherein the at least first damper device is arranged between the first spring device and the second spring device.

7. The running gear as claimed in claim 1, wherein the first spring device, the second spring device, the third spring device and the fourth spring device are arranged horizontally.

8. The running gear as claimed in claim 1, wherein the first spring device, the second spring device, the third spring device and the fourth spring device are formed as laminated springs.

9. The running gear as claimed in claim 1, wherein the first spring device, the second spring device, the third spring device and the fourth spring device are formed as wire rope dampers.

10. The running gear as claimed in claim 1, wherein the first spring device, the second spring device, the third spring device and the fourth spring device are formed as fluid springs.

11. The running gear as claimed in claim 1, wherein the damper of the at least first damper device is formed as a hydraulic bearing.

12. The running gear as claimed in claim 1, wherein that the damper of the at least first damper device is embodied as a rubber damper.

13. The running gear as claimed in claim 1, wherein a first holder to which the first spring device is connected and a second holder, to which the second spring device is connected, are formed at least from the first wheelset bearing housing.

14. The running gear as claimed in claim 13, wherein the at least first damper device is encased by the first wheelset bearing housing or the swing arm, the first holder, the second holder and a cover connected to the first holder and the second holder.

15. The running gear as claimed in claim 1, wherein at least one first carrier to which the first spring device, the second spring device and the at least first damper device are connected, is coupled to the at least first drive unit.

16. The running gear as claimed in claim 1, wherein the running gear is an internally supported running gear.

* * * * *